US008739714B2

(12) United States Patent
Klapp

(10) Patent No.: US 8,739,714 B2
(45) Date of Patent: Jun. 3, 2014

(54) METHOD FOR OPERATING A CHAIN STITCH SEWING MACHINE AND CHAIN STITCH SEWING MACHINE

(75) Inventor: Harmut Klapp, Kaarst (DE)

(73) Assignee: Nahmaschinenfabrik Emil Stutznacker GmbH & Co. KG (DE)

( * ) Notice: Subject to any disclaimer, the term of this patent is extended or adjusted under 35 U.S.C. 154(b) by 0 days.

(21) Appl. No.: 13/524,079

(22) Filed: Jun. 15, 2012

(65) Prior Publication Data

US 2013/0092066 A1 Apr. 18, 2013

(30) Foreign Application Priority Data

Jul. 1, 2011 (EP) ..... 11005385
Aug. 18, 2011 (EP) ..... 11006743

(51) Int. Cl.
*D05B 1/08* (2006.01)
*D05B 57/02* (2006.01)
*D05B 65/00* (2006.01)

(52) U.S. Cl.
USPC ..... 112/475.17; 112/199; 112/253; 112/285

(58) Field of Classification Search
USPC ..... 112/197–202, 296, 298, 475.01, 112/475.08, 475.17, 285
See application file for complete search history.

(56) References Cited

U.S. PATENT DOCUMENTS

| | | | | |
|---|---|---|---|---|
| 525,043 | A | 8/1894 | Borton et al. | |
| 2,778,329 | A * | 1/1957 | Howell et al. | 112/199 |
| 2,851,974 | A * | 9/1958 | Hayes | 112/461 |
| 3,599,588 | A * | 8/1971 | Angele | 112/288 |
| 4,903,623 | A * | 2/1990 | Adamski et al. | 112/286 |
| 5,333,565 | A * | 8/1994 | Frye | 112/291 |
| 6,119,613 | A * | 9/2000 | Douyasu et al. | 112/475.17 |
| 6,766,752 | B2 * | 7/2004 | Chang | 112/253 |

FOREIGN PATENT DOCUMENTS

| | | | |
|---|---|---|---|
| EP | 1 388 601 | A2 | 2/2004 |
| WO | 2011/001289 | A2 | 1/2011 |

* cited by examiner

*Primary Examiner* — Ismael Izaguirre
(74) *Attorney, Agent, or Firm* — John Wilson Jones; Jones & Smith, LLP

(57) ABSTRACT

A method for operating a chain stitch sewing machine and a chain stitch sewing machine, the chain stitch sewing machine having a pair of sewing members comprising a needle which pierces a sewing material and a gripper disposed below a sewing material rest, which can be moved along a movement path, where an upper thread is guided with the needle through the sewing material resting on the sewing material rest, which is linked to a lower thread. The lower thread is fed to a retaining element and is held in said element that is moved with regard to its direction of movement and/or speed of movement to the sewing material rest according to a movement path of a pivoting movement of the gripper in particular along a circular-arc-segment-shaped movement path.

14 Claims, 8 Drawing Sheets

6
3
5
4
2
1
20
20
19
21
23
22
14
24
16
11
13
18
9
12
17
10
15
7
8

METHOD FOR OPERATING A CHAIN STITCH SEWING MACHINE AND CHAIN STITCH SEWING MACHINE

The invention relates to a method for operating a chain stitch sewing machine, in particular a double chain stitch sewing machine, preferably a multi-needle double chain stitch sewing machine, which comprises a pair of sewing members comprising a needle which pierces a sewing material and a gripper disposed below a sewing material rest, which can be moved along a movement path, wherein an upper thread is guided with the needle through the sewing material resting on the sewing material rest, which is linked to a lower thread. The invention further relates to a chain stitch sewing machine, in particular a double chain stitch sewing machine, preferably a multi-needle double chain stitch sewing machine, comprising a pair of sewing members comprising a needle which pierces a sewing material and a gripper disposed below a sewing material rest, which can be moved along a movement path, wherein the needle guides an upper thread through the sewing material resting on the sewing material rest and the upper thread is linked to a lower thread.

Such methods and sewing machines are known from the prior art.

For example, DE 43 15 802 C2 describes a multi-needle chain stitch sewing machine which comprises a pair of sewing members comprising a needle which pierces a sewing material and a gripper disposed below a sewing material rest, which can be moved along a circular-arc-segment shaped movement path. An upper thread is guided with the needle through the sewing material resting on the sewing material rest and is connected to a lower thread below the sewing material rest, namely linked, so that a double chain stitch is formed in the sewing material.

In the multi-needle double chain stitch sewing machine known previously from the aforesaid document, the gripper can fundamentally be moved to and fro during the sewing process along a circular-arc-segment-shaped movement path between two end positions so that the gripper executes an oscillating movement. If necessary, the gripper can then be driven by means of a crank assembly so that the gripper now executes an additional movement along the circular-arc-segment-shaped movement path compared to the usual oscillating movement during the sewing process. By this means the upper thread enters into the area of a gripper knee in which a cutting blade is located which is used to cut the upper thread.

Known from U.S. Pat. No. 5,154,130 is another embodiment of a such a multi-needle sewing machine in which the upper thread is to be cut at a given time. In this previously known multi-needle sewing machine, a spreader usually provided is additionally shown which cooperates with needle and gripper and has a semicircular-shaped recess in which a cutting edge is disposed so that the upper thread can be specifically cut by means of this cutting edge of the spreader as soon as this is provided.

This document shows very clearly in FIGS. 5*a*) to 5*m*) the usual sequence of the formation of a chain stitch, where FIGS. 5*a*) to 5*i*) show the usual sewing process and FIGS. 5*j*) to 5*m*) show the cutting of the upper thread.

The prior art presented previously fundamentally shows possibilities as to how the upper thread can be cut at the desired time. This time can, for example, be preset by an electronic control of the multi-needle sewing machine and in particular may be necessary when changing the sewing area in large-size sewing material. The same applies if different sewing material patterns are to be executed in a large-size sewing material. Such cutting of the upper thread prevents any finishing process of the sewing material at the end of the sewing process in which the upper thread which does not run through the sewing material between adjacent sewing patterns is trimmed manually or by machine. In this regard, it has proved to be a disadvantage that a subsequent trimming of the upper thread results in a major expenditure. Furthermore, such manual and/or mechanical finishing processes are time- and work-intensive and do not necessarily lead to a requisite uniformity of the sewing material pattern on the visible surface of the sewing material.

In generic chain stitch sewing machines, a lower thread and an upper thread are therefore linked to one another. In large-area sewing materials, for example, mattress parts, it is usual for these sewing material patterns to be provided with a plurality of usually identical sewing material patterns which are sewn into the sewing material layer separately from one another. It is known to cut the upper thread at the end of a sewing material pattern in order to subsequently avoid the removal of unsewn upper thread sections or upper thread residues. This is used to facilitate the work and naturally increases the visual impression of quality. In the area of the lower thread removal of unsewn lower thread sections is not absolutely necessary in order to meet the preceding requirements. This is on the one hand because in particular these mattress elements are connected to one another ensheathing a core, wherein the surfaces are with the lower threads are disposed in the inner area of the mattress so that lower threads or lower thread sections remaining here do not have a perturbing effect.

Nevertheless, there is naturally a requirement to reduce the consumption of lower thread material in order to be able to offer competitive products. In the prior art it is known to also trim these lower threads after completing a sewing material pattern. However the problem has arisen here that the sewing of the next sewing material pattern is made difficult insofar as lower thread and upper thread must be brought together to form a new thread chain. Furthermore, there is the risk that the lower threads will slip out of these grippers as a result of the oscillating movement of the grippers.

This is where the invention starts. It is the object of the invention to further develop a generic method for operating a chain stitch sewing machine in such a manner that in order to form a clean sewing material pattern image on the underside of the sewing material, the required amount of thread of the lower thread is reduced and the commencement of sewing in the area of a subsequent sewing material pattern is simplified. It is further the object of the invention to configure a generic chain stitch sewing machine in such a manner that a method according to the invention can be executed in an advantageous manner avoiding the disadvantages set out previously in an economical manner.

In order to solve this formulation of the problem, it is provided on the part of the method according to the invention that the lower thread is fed as required to a retaining element and is held in said element, that is moved with regard to its direction of movement and/or speed of movement to the sewing material rest according to a movement path of a pivoting movement of the gripper, in particular along a circular-arc-segment-shaped movement path.

The method according to the invention thus ensures that the lower thread is fixed during the sewing process in which specific needles do not participate in the sewing process whilst the entirety of the grippers are still moved in an oscillating manner. Furthermore, the commencement of sewing of a new thread chain is simplified whereby the lower thread is fixed and can be gripped in a simple manner in the next stitch process and connected to the upper thread.

The last-mentioned advantage is achieved in particular whereby the lower thread is arranged tensioned between gripper and retaining element. Due to the tensioning in the lower thread, this is fundamentally located in a specific region so that the sewing process, namely the piercing of the needle can be used as a defined location in order to hold the tensioned lower thread available for an advantageous sewing.

For this purpose it has proved advantageous that the lower thread is disposed substantially anti-parallel to the longitudinal axis of the gripper running between its tip and the retaining element. The gripper is usually L-shaped and consequently has two legs. With the first leg the gripper is inserted into a gripper holder which is connected in a torque-proof manner to a gripper shaft. This configuration has the advantage that the gripper can be exchanged in a simple manner, for example, in the event of defects. The second leg of the gripper with the gripper tip through which the lower thread usually runs extends substantially at right angles to the first leg. This leg consequently has a longitudinal axis which is here designated as the longitudinal axis of the gripper. The lower thread advantageously runs deviating in an anti-parallel manner from this longitudinal axis so that the lower thread and this leg of the gripper are aligned so that they run in a V shape. The needle with the upper thread can pierce into a triangle formed by this V-shaped profile at the beginning of the following sewing process in order to thus link the lower thread to the upper thread.

According to a further feature of the invention, it is provided that the lower thread is fed to the retaining element before or during a cutting process executed with a cutting tool, in particular of the lower thread both the upper thread and the lower thread can be cut with the gripper. To this end, two different cutting devices are usually provided. Advantageously the lower thread is transferred into the retaining element and held therein before executing a cutting process. Following this, the cutting process can then be executed outside the length of the lower thread between the gripper tip and the retaining element so that this area of the lower thread is also tensioned on the gripper after executing the cutting process. In principle, the cutting process can also be executed simultaneously with transferring the lower thread into the retaining element.

According to a further feature of the invention, it is provided that the cutting tool is moved during the cutting process into the area of the lower thread, in particular until at least one cutting surface abuts against the lower thread and the cutting process is executed by a movement of the sewing material relative to the sewing material rest and/or by an additional movement of the cutting tool. At this time, the lower thread is already arranged and fixed in the retaining element.

The cutting tool is preferably moved jointly with the gripper and the retaining element. This can be accomplished, for example, by fastening both the gripper, and also the cutting tool and the retaining element on the gripper holder so that these components execute identical movements with regard to their direction of movement and also with regard to their speed of movement. The retaining element can, however also be fastened directly on the gripper and therefore only indirectly on the retaining element. The same naturally also applies with regard to the cutting tool.

In the method according to the invention it is provided as a further development that the cutting tool, the gripper and the retaining element are moved during the sewing process on a circular-arc-segment shaped movement path into a region in which the cutting tool does not come in contact with the lower thread and that in order to execute the cutting process, cutting tool, gripper and retaining element are moved along the movement path with the same direction of movement beyond the region. It is hereby provided that the lower thread is disposed in the retaining element before the cutting tool comes in contact with the lower thread.

The time sequence of the preceding fastening of the lower thread in the retaining element and the subsequent cutting process follows from this.

In a sewing machine according to the invention, the solution of the previously present formulation of the object provides a retaining element for holding the lower thread as required, that can be moved with regard to its direction of movement and/or speed of movement to the sewing material rest according to a movement path of a pivoting movement of the gripper, in particular along a circular-arc-segment-shaped movement path.

In the chain stitch sewing machine according to the invention, a retaining element is therefore provided which receives the lower thread if required and fixes this over a certain time interval. A requirements exists, for example, at the end of sewing material pattern in which upper thread and lower thread are cut, the sewing material is moved relative to the sewing members and a new sewing material pattern is begun with upper thread and lower thread. This retaining element can be moved with respect to its direction of movement and/or speed of movement to the sewing material rest according to a movement path of a pivoting movement of the gripper. This movement path is preferably formed in the shape of a circular arc segment and is obtained from the oscillating movement of the gripper shaft with the grippers disposed thereon.

According to a further feature of the invention, it is provided that the retaining element is disposed on the gripper, in particular in the area of a section of the gripper that can be connected to a gripper shaft. The retaining element can, for example, be screwed to a leg of the gripper. Alternatively, the retaining element can naturally also be disposed in the area of the gripper holder. This results in any case in a concurrent movement of the retaining element with the gripper.

It is further provided that the retaining element is disposed in the longitudinal axial direction of the gripper between the gripper and a cutting tool, where the cutting tool can be moved together with the gripper. The cutting tool can cut the lower thread, for example, by an additional movement of the gripper shaft with the grippers in the direction of the lower thread. Alternatively it is possible that the cutting process is executed by a movement of the sewing material on the sewing material rest in which the lower thread is pulled into the cutting tool.

The arrangement of the retaining element between the gripper and the cutting tool has the advantage that it is ensured that particularly in the first-mentioned cutting method, the retaining element previously comes in contact with the lower thread so that this is clamped in the retaining element.

The retaining element is preferably disposed with respect to the gripper in such a manner that the retained thread extends substantially anti-parallel to a leg of the approximately L-shaped gripper. In this embodiment the lower thread runs in its fixed arrangement between the gripper tip and the retaining element disposed, for example, in the transition zone of the two legs of the gripper with respect to one another, where the retaining element is disposed laterally offset to the leg with the tip so that the lower thread runs substantially anti-parallel to the longitudinal axis of the leg with the tip.

According to a further feature of the invention, it is provided that the retaining element consists of a base body that can be connected to a gripper holder, the gripper shaft and/or the gripper and a spring-elastic element fastened thereon, which is connected at a first end to the base body and the second end thereof can be moved relative to the base body and abuts against the base body. This spring-elastic element is preferably formed from spring steel.

The spring-elastic element can have a slightly offset configuration so that the free end of the spring-elastic element is raised from a surface of the base body so that the insertion of the lower thread between the spring-elastic element and the base body of the retaining element is simplified. With the rest of the region the spring-elastic element abuts under spring pre-tension against the base body of the retaining element. This basic spring pre-tension is dimensioned in such a manner that a sufficiently large retaining force is provided, but at the same time the lower thread can be removed free from damage from the retaining element at the beginning of a new sewing material pattern. This is accomplished, for example, by needle and upper thread. It is further provided that the retaining element has a guide surface over which the lower thread is guided into a retained position depending on the angular position of the gripper relative to the sewing material rest.

Finally, according to a further feature of the invention, it is provided that cutting tool, retaining element and gripper are disposed in such a manner with respect to one another that the lower thread is disposed in the retaining element before reaching the cutting tool.

The guide surface described previously is preferably located on the base body of the retaining element and guides the lower thread into the area of the spring-elastic element until the lower thread is tensioned between the base body and the spring-elastic element.

Further features and advantages of the invention are obtained from the following description of the relevant drawings which show a pair of sewing members comprising needle and gripper in different positions relative to a sewing material rest. In the drawings:

With reference to FIG. 1, the essential structural elements of a sewing machine required to explain the invention are presented and described hereinafter, to which reference is then made with the same reference numbers in relation to the further FIGS. 2 to 6.

Figure 1:
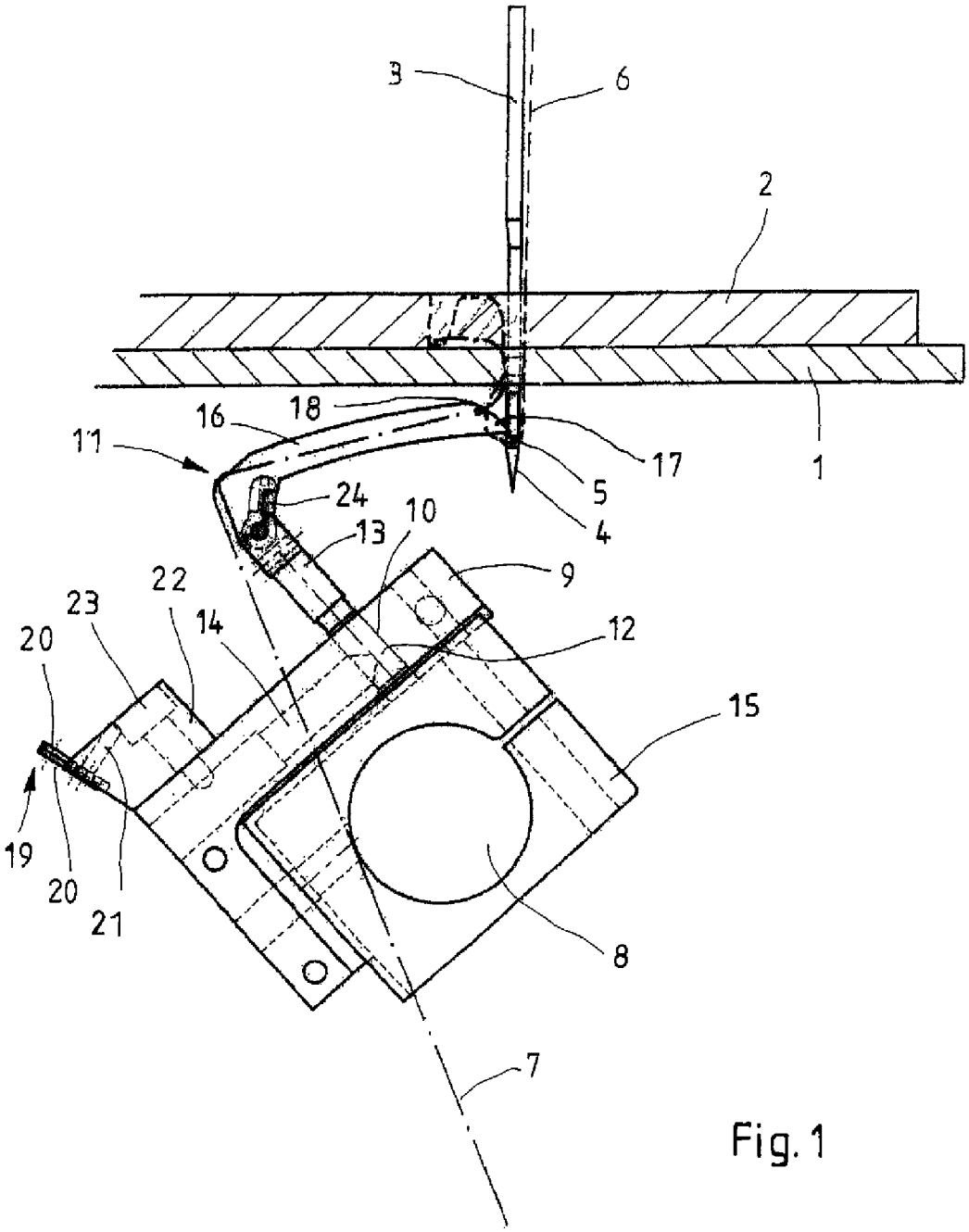
FIG. 1 shows a pair of sewing members in side view in a first position to form a chain stitch.

FIG. 1 shows a sewing material rest 1 on which a sewing material 2, for example, a multi-layer sewing material is placed, which can be moved relative to the sewing material rest 1.

Located above the sewing material rest 1 is a needle 3 which can be moved to and fro in an oscillating manner between two positions, where one position is shown in FIG. 1 and one position is shown in FIGS. 2 to 6. In the position of the needle 3 shown in FIG. 1, the needle 3 has been pierced into the sewing material 2 and passes through the sewing material rest 1 which for this purpose has an opening not shown in detail.

In its tip 4 the needle 3 has an eye 5 through which an upper thread 6 is guided which is shown by the dashed line for better identifiability in all FIGS. 1 to 6.

A lower thread 7 should be distinguished from this, which is described subsequently with regard to its course and which is shown by the dot-dash line for better distinguishability from the upper thread 6.

FIG. 1 also shows a gripper shaft 8 disposed below the sewing material rest 1, to which a gripper holder 9 is detachably fastened. The gripper holder 9 has a hole 10 into which a substantially L-shaped gripper 11 is inserted with an insertion end 12 in the area of a first leg 13. The gripper 11 is locked by a locking screw in the hole 10 which can be screwed in a corresponding threaded hole 14.

The gripper holder 9 itself is also substantially L-shaped and screwed with the gripper shaft 8 in the area of a clamping element having a substantially rectangular cross-section.

The gripper 11 has a second leg 16 with a free end which is designated as gripper tip 17. A hole 18 through which the lower thread 7 is guided is located in the area of this gripper tip 17.

Furthermore, a cutting tool 19 is provided which is screwed to the gripper holder 9. The cutting tool 19 is located after the gripper where the term "located after" refers to a direction of motion of the gripper during the usual sewing process in the direction of the gripper tip 17.

The cutting tool 19 consists of two blades 20 which are screwed to a cutting tool holder 22 by means of a screw 21 enclosing an acute angle to one another. The cutting tool holder 22 is in turn screwed by means of a screw 23 to the gripper holder 9.

After loosening the screw 21, the two blades 20 of the cutting tool 19 can be changed in their angular position relative to one another so that a more or less large angle is obtained between the mutually facing blades 20, whereby the blades 20 and therefore the cutting tool 19 can be adjusted to parameters of the lower thread such as, for example, thread thickness and thread material.

FIG. 1 shows a usual starting position when sewing a chain stitch. The gripper 11 in this case grips with its gripper tip 17 in the needle thread loop of the upper thread 6 and connects the lower thread 7 guided by the gripper to the upper thread 6. The needle 3 is then moved into the upper position shown in FIG. 2 whereby the needle thread loop slides over the leg 16 of the gripper 11. During the usual sewing process, the gripper 11 is then pivoted back into a position substantially according to FIG. 1 and the needle 3 pierces through the sewing material 2 with the upper thread 6 before the gripper 11 is again pivoted from the position shown in FIG. 1 into the position shown in FIG. 2.

Figure 2:
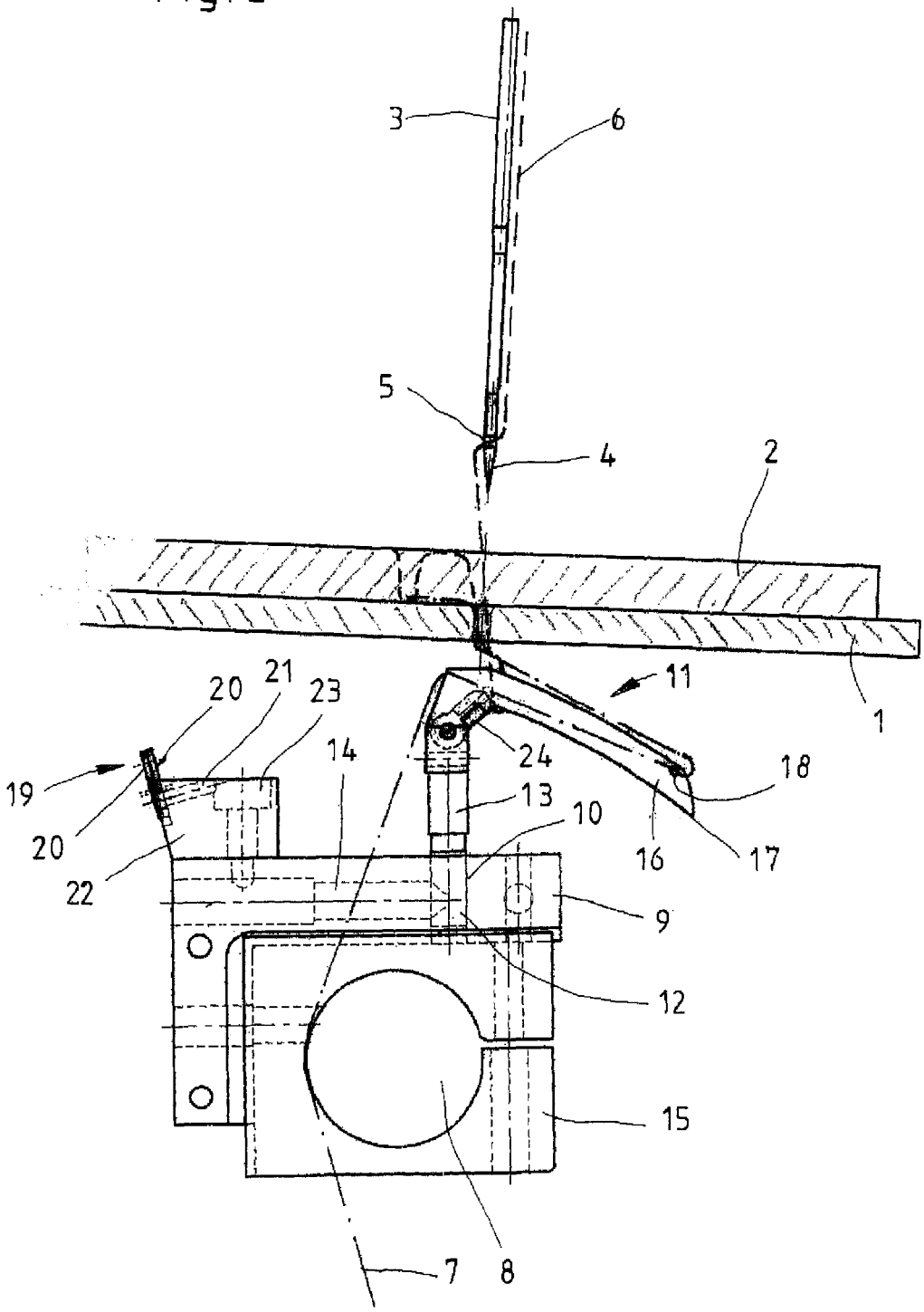
FIG. 2 shows the pair of sewing members according to FIG. 1 in a second position to form a chain stitch.
Figure 3:
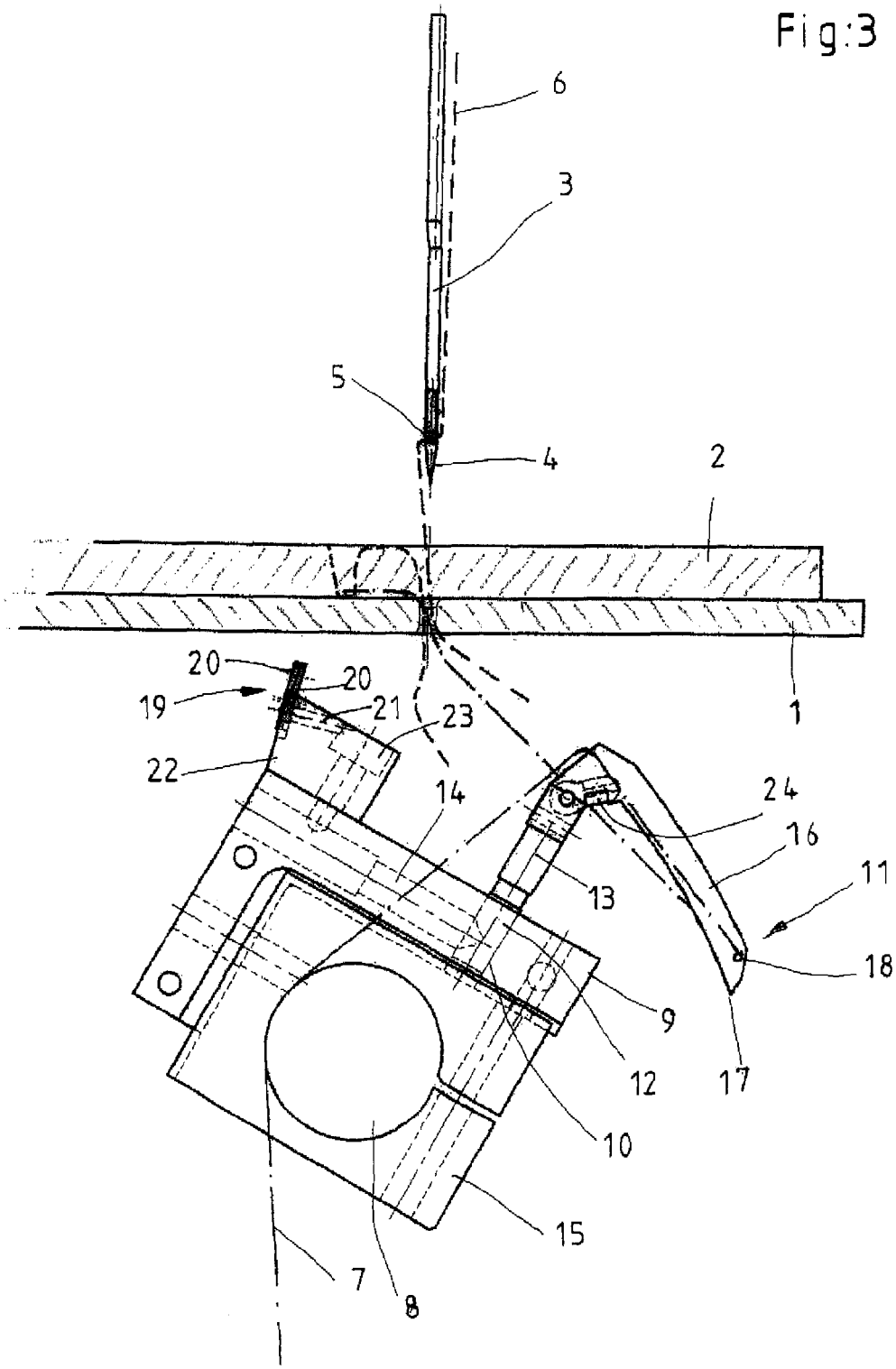
FIG. 3 shows the pair of sewing members according to FIG. 1 and FIG. 2 in a third position after cutting an upper thread.

FIG. 3 shows a position of the gripper 11 in which the gripper 11 is pivoted out beyond the position according to FIG. 2 in order to cut the upper thread 6 by means of a cutting tool 24 provided in the transition of the legs 13 and 16. The lower thread 7 is tensioned in this case.

Figure 4:
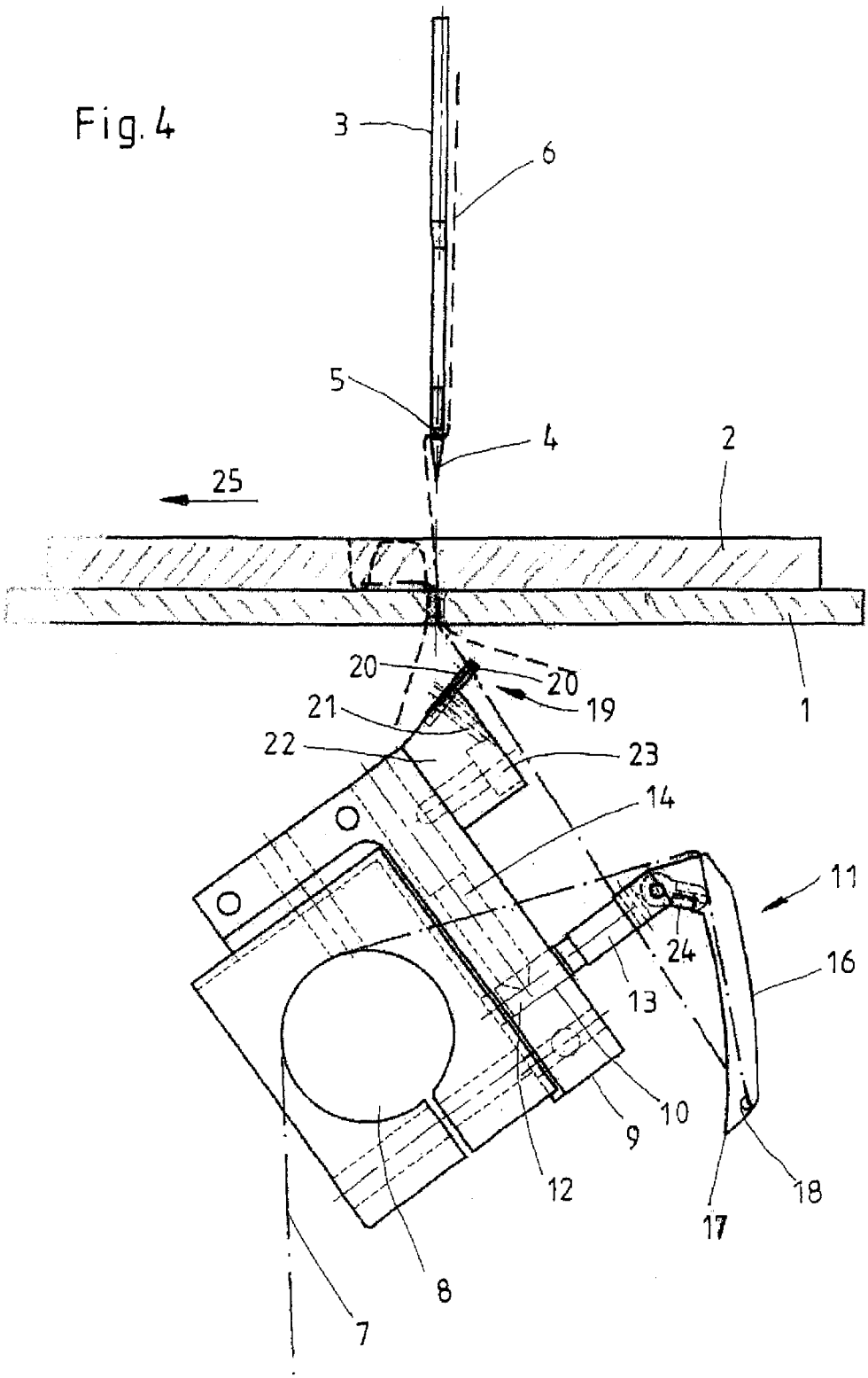
FIG. 4 shows the pair of sewing members according to FIGS. 1 to 3 in a fourth position shortly before a cutting of a lower thread.
Figure 5:
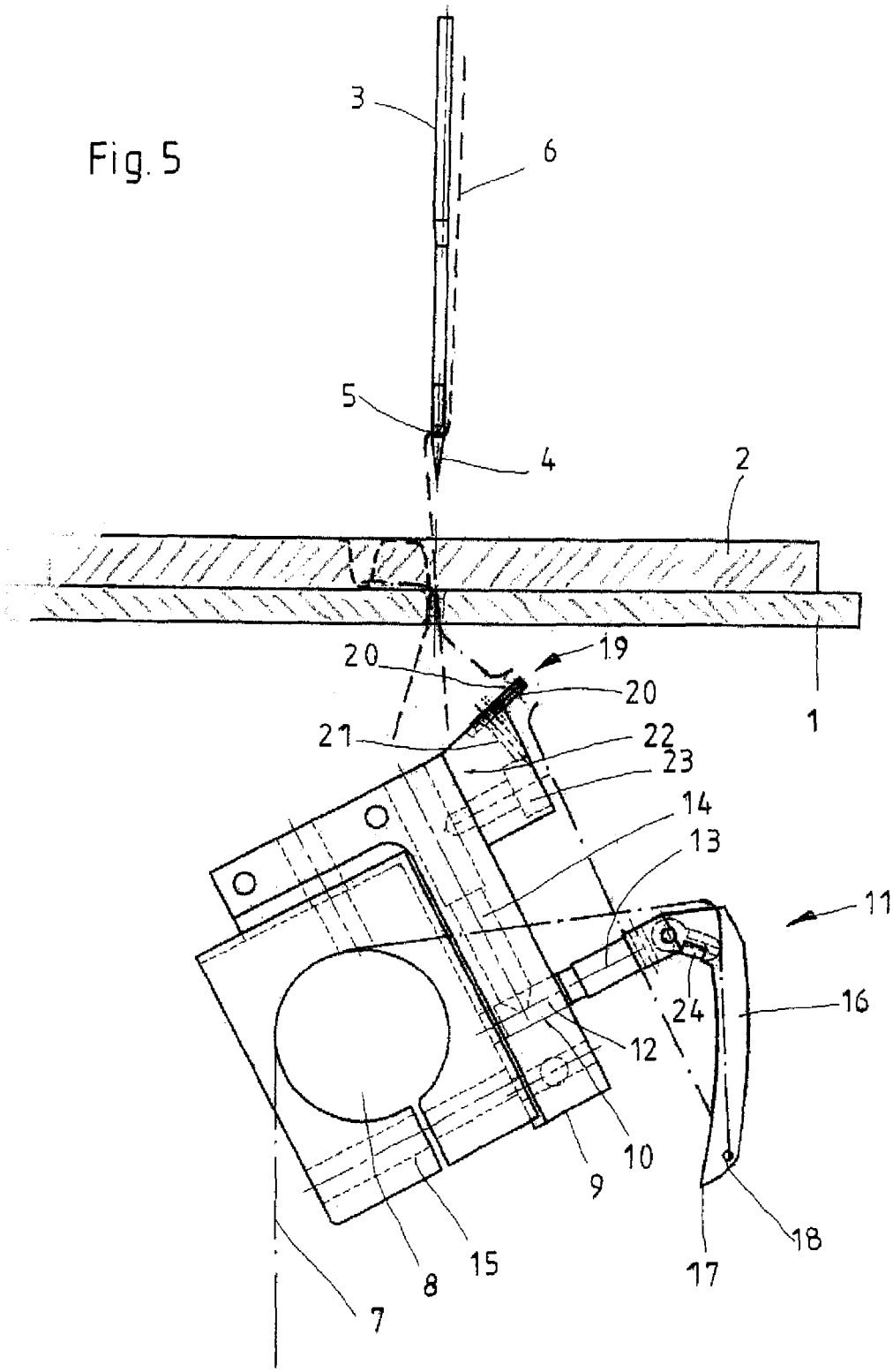
FIG. 5 shows the pair of sewing members according to FIGS. 1 to 4 in a fifth position during the cutting process of the lower thread.

If the gripper 11 is now pivoted further in the clockwise direction, the lower thread 7 enters into a position between the two blades 20 of the cutting tool 19. A slight further pivoting of the gripper 11 according to FIG. 5 is now sufficient in order to cut the lower thread by means of the cutting tool 19. Additionally and/or alternatively it can be provided that in one position of the gripper 11 according to FIG. 4, the sewing material 2 is moved in the direction of an arrow 25 so that the lower thread 7 is hereby pulled into a V-shaped recess between the blades 20 and is cut at the blades 20.

In both cases the lower thread is trimmed to a length which is sufficient to avoid any opening of the stitch. The sewing material is then moved into a new position relative to the needle 3 in order, for example, to begin a new sewing material pattern.

Figure 6:
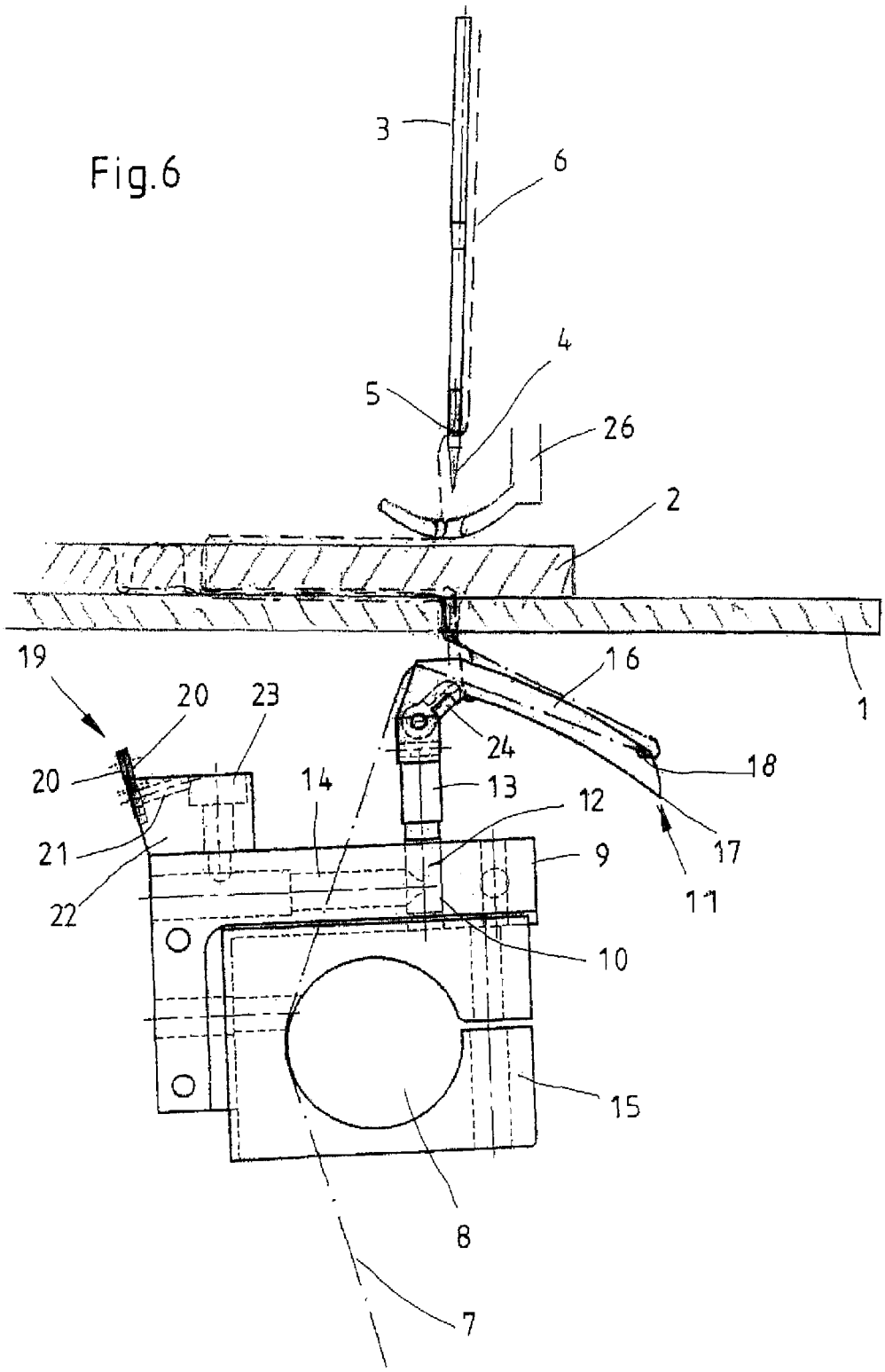
FIG. 6 shows a further position of the pair of sewing members according to FIGS. 1 to 5 to adjust a residual thread length before cutting the lower thread.

FIG. 6 additionally shows the basic possibility of adjusting the residual thread length of the lower thread 7 but also of the upper thread 6 by sliding the sewing material 2 relative to the sewing material rest 1 so that the lower thread 7 is cut with a sufficient length remaining on the sewing material 2. A presser foot 26 is additionally shown in FIG. 6.

The adjustment of the residual thread length of the lower thread 7 according to FIG. 6 is not restricted to the position of the gripper 11 relative to the sewing material 2 which is shown. A corresponding sliding of the sewing material 2 relative to the sewing material rest into the positions of the gripper 11 as shown in FIGS. 3 to 5 is naturally also possible.

FIGS. 7 to 10 show the embodiment of a gripper 11 with a gripper holder 9 and a tensioning element 15 by which means gripper holder 9 and gripper 11 are tensioned on a gripper shaft 8. In addition, FIGS. 7 to 10 show the cutting tool 19 with the blade 20 which is connected via the screw 21 to the gripper holder 9.

In addition, a retaining element 27 can be further identified from FIGS. 7 to 10, which is disposed between the leg 13 of the gripper 11 and the cutting tool holder 22, wherein the retaining element 27 is screwed by means of a screw 28 to the leg 13 of the gripper 11.

The retaining element 27 consists of a base body 29 and a spring-elastic element 30, for example, a spring steel. The spring-elastic element 30 is fixed by means of a screw 31 on the base body 29 of the retaining element 27 in such a manner that one free end 32 of the spring-elastic element 30 can be moved relative to the base body 29 against the spring force of the spring-elastic element 30. Substantially the spring-elastic element 30 abuts against the base body 29 in order to clamp a lower thread between base body 29 and spring-elastic element 30 as required. Only the free end 32 is located at a distance from the base body 29 in order to facilitate the threading of the lower thread 7 between the base body 29 and the spring-elastic element 30.

In addition, the base body 29 has a guide surface 33 over which the lower thread 7 can be transferred as required and when the gripper holder 9 with the gripper 11 is pivoted accordingly in the direction of the spring-elastic element 30 and therefore into the clamping hold.

Figure 8:
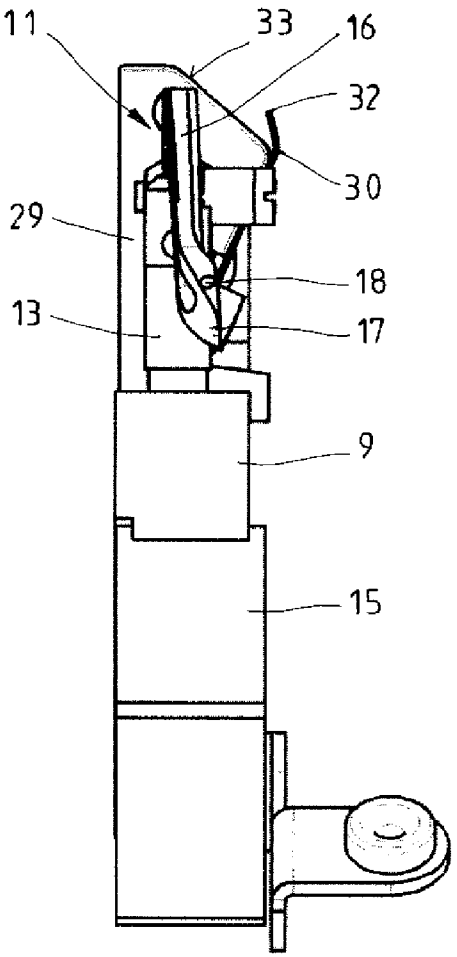
FIG. 8 shows the gripper according to FIG. 7 in side view.
Figure 7:
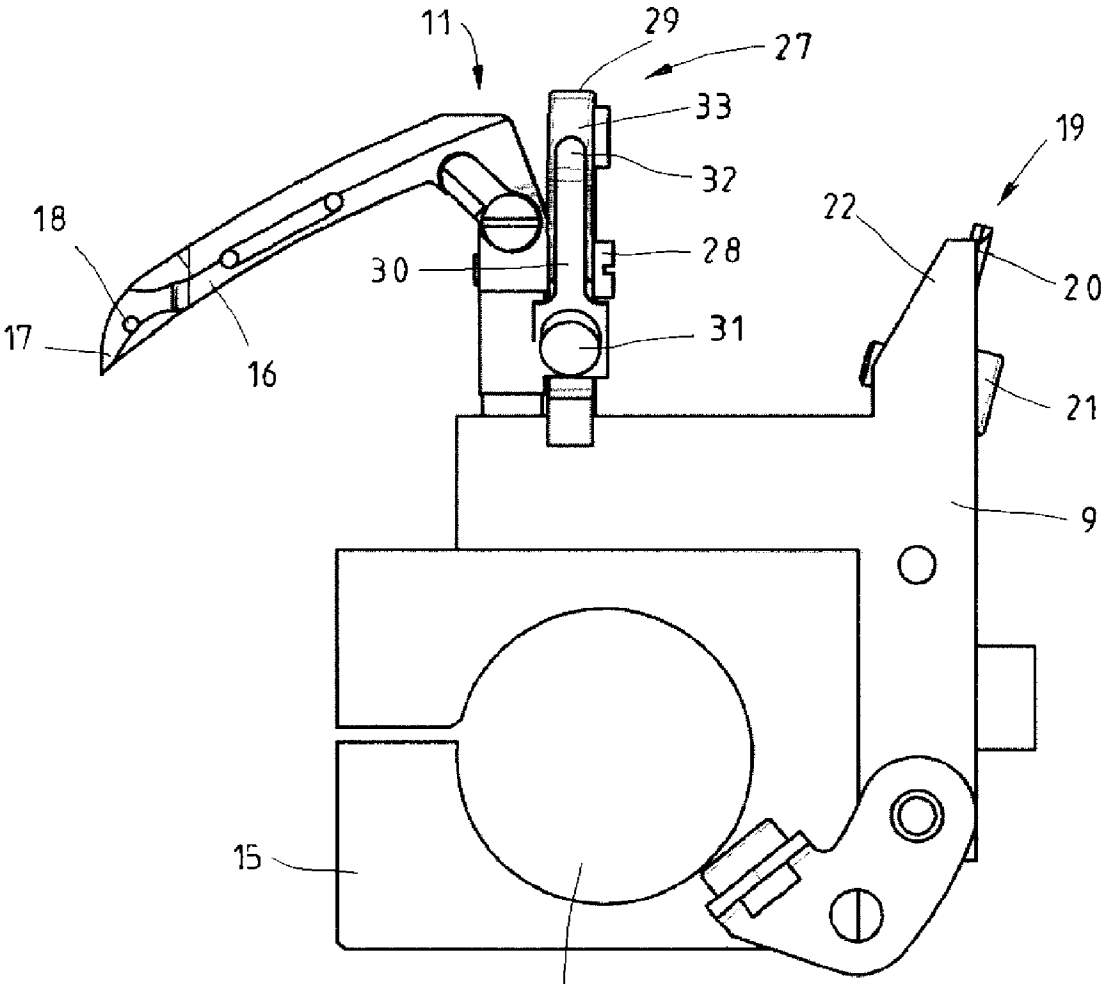
FIG. 7 shows a gripper in view.
Figure 10:
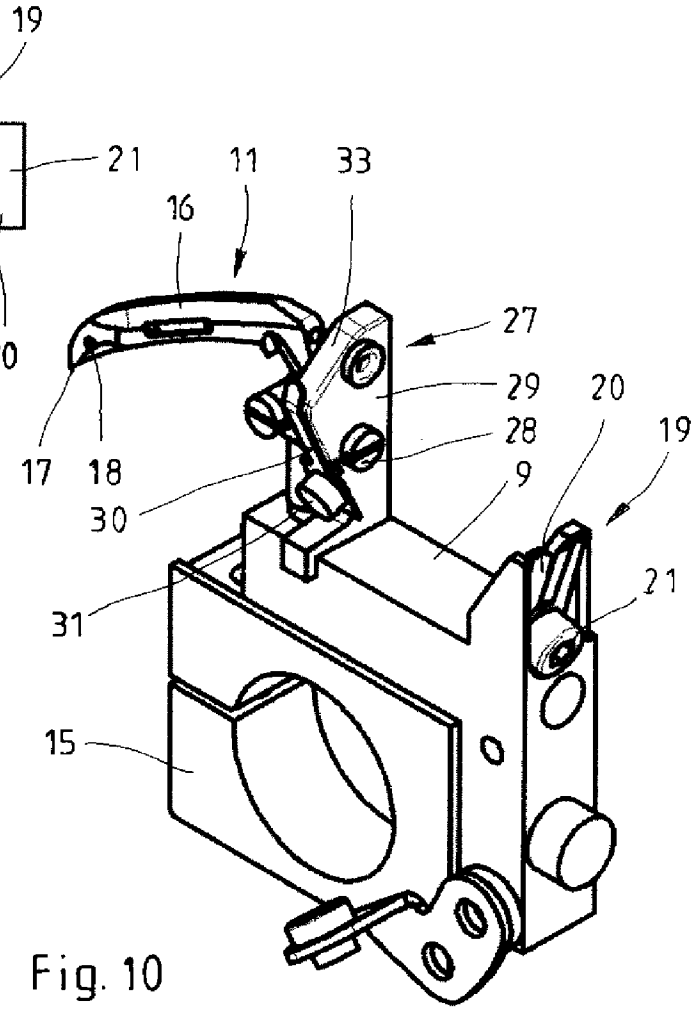
FIG. 9 shows the gripper according to FIGS. 7 and 8 in plan view and FIG. 10 shows the gripper according to FIGS. 7 to 9 in perspective view.
Figure 9:
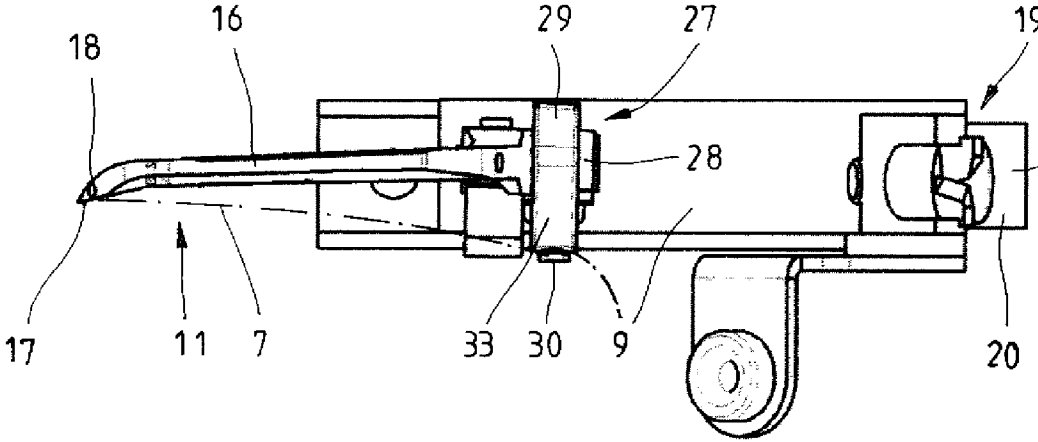

In particular, it can be seen from FIGS. 8 to 10 that the region of the retaining element 27 in which the lower thread is held between base body 29 and the spring-elastic element 30 as required is arranged laterally offset to the longitudinal axis of the gripper 11 so that the lower thread 7 emerging from the hole 18 when arranged in the retaining element 27 is aligned to that it runs anti-parallel to the longitudinal axis of the gripper 11 and runs with the gripper in V-shaped alignment so that in a subsequent stitch formation the needle 3 (FIG. 1) pierces between the lower thread and the gripper 11, and pulls out the lower thread 7 from the retaining element 27 during the upwards movement.

REFERENCE LIST

1 Sewing material rest
2 Sewing material
3 Needle
4 Needle tip
5 Needle eye
6 Upper thread
7 Lower thread
8 Gripper shaft
9 Gripper holder
10 Hole
11 Gripper
12 Insertion end
13 Leg
14 Hole
15 Tensioning element
16 Leg
17 Gripper tip
18 Hole
19 Cutting tool
20 Blade
21 Screw
22 Cutting tool holder
23 Screw
24 Cutting tool
25 Arrow
26 Presser foot
27 Retaining element
28 Screw
29 Base body
30 Spring-elastic element
31 Screw
32 End
33 Guide surface

The invention claimed is:

1. A method for operating a double chain stitch sewing machine, which comprises a pair of sewing members comprising a needle which pierces a sewing material and a gripper disposed below a sewing material rest, which can be moved along a movement path, wherein an upper thread is guided with the needle through the sewing material resting on the sewing material rest, which is linked to a lower thread, characterized in that the lower thread is fed as required to a retaining element and is held in said element, that is moved with regard to its direction of movement and/or speed of movement to the sewing material rest according to a movement path of a pivoting movement of the gripper, in particular along a circular-arc-segment-shaped movement path and in that the lower thread is arranged tensioned between gripper and retaining element.

2. The method according to claim 1, characterized in that the lower thread is disposed substantially anti-parallel to the longitudinal axis of the gripper running between its tip and the retaining element.

3. The method according to claim 1, characterized in that the lower thread is fed to the retaining element before or during a cutting process executed with a cutting tool, in particular of the lower thread.

4. The method according to claim 3, characterized in that the cutting tool is moved during the cutting process into the area of the lower thread, in particular until at least one cutting surface abuts against the lower thread, and the cutting process is executed by a movement of the sewing material relative to the sewing material rest and/or by an additional movement of the cutting tool.

5. The method according to claim 3, characterized in that the cutting tool is moved jointly with the gripper and the retaining element.

6. The method according to claim 3, characterized in that the cutting tool, the gripper and the retaining element are moved during the sewing process on a circular-arc-segment shaped movement path into a region in which the cutting tool does not come in contact with the lower thread and that in order to execute the cutting process, cutting tool, gripper and retaining element are moved along the movement path with the same direction of movement beyond the region.

7. A double chain stitch sewing machine, which comprises a pair of sewing members comprising a needle which pierces a sewing material and a gripper disposed below a sewing material rest, which can be moved along a movement path, wherein the needle guides an upper thread through the sewing material resting on the sewing material rest and the upper thread is linked to a lower thread, characterized by a retaining element for holding the lower thread as required in a tensioned way between gripper and retaining element which retaining element can be moved with regard to its direction of movement and/or speed of movement to the sewing material rest according to a movement path of a pivoting movement of the gripper, in particular along a circular-arc-segment-shaped movement path.

8. The sewing machine according to claim 7, characterized in that the retaining element is disposed on the gripper, in particular in the area of section of the gripper that can be connected to a gripper shaft.

9. The sewing machine according to claim 7, characterized in that the retaining element is disposed in the longitudinal axial direction of the gripper between the gripper and a cutting tool, wherein the cutting tool can be moved together with the gripper.

10. The sewing machine according to claim 7, characterized in that the retaining element is disposed with respect to the gripper in such a manner that the retained thread extends substantially anti-parallel to a leg of the approximately L-shaped gripper.

11. The sewing machine according to claim 7, characterized in that the retaining element consists of a base body that can be connected to a gripper holder, the gripper shaft and/or the gripper and a spring-elastic element fastened thereon, which is connected at a first end to the base body and the second end thereof can be moved relative to the base body and abuts against the base body.

12. The sewing machine according to claim 11, characterized in that the spring-elastic element is formed from spring steel.

13. The sewing machine according to claim 7, characterized in that the retaining element has a guide surface over which the lower thread is guided into a retained position depending on the angular position of the gripper relative to the sewing material rest.

14. The sewing machine according to claim 9, characterized in that cutting tool, retaining element and gripper are disposed in such a manner with respect to one another that the lower thread is disposed in the retaining element before reaching the cutting tool.

* * * * *